US007215913B2

(12) United States Patent
Miyamoto

(10) Patent No.: US 7,215,913 B2
(45) Date of Patent: May 8, 2007

(54) TRANSFER BELT AND IMAGE-FORMING APPARATUS HAVING THE SAME

(75) Inventor: Takahito Miyamoto, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 130 days.

(21) Appl. No.: 10/918,422

(22) Filed: Aug. 16, 2004

(65) Prior Publication Data

US 2005/0244196 A1 Nov. 3, 2005

(30) Foreign Application Priority Data

Apr. 28, 2004 (JP) ..... 2004-132540

(51) Int. Cl.
*G03G 15/14* (2006.01)

(52) U.S. Cl. ..... 399/313; 399/297; 525/431; 525/446; 525/474

(58) Field of Classification Search ..... None
See application file for complete search history.

(56) References Cited

U.S. PATENT DOCUMENTS 5,666,193 A 9/1997 Rimai et al.
2002/0102410 A1* 8/2002 Gervasi et al. ..... 428/421
2004/0142259 A1* 7/2004 Uesugi et al. ..... 430/58.2
2005/0196202 A1* 9/2005 Suzuki et al. ..... 399/302

FOREIGN PATENT DOCUMENTS

| | | | |
|---|---|---|---|
| JP | 04-029275 | | 1/1992 |
| JP | 10-010880 | | 1/1998 |
| JP | 10-207242 | | 8/1998 |
| JP | 2002-365866 | | 12/2002 |
| JP | 2004/46062 | * | 2/2004 |
| JP | 2004-191554 | * | 8/2004 |

OTHER PUBLICATIONS abstract of JP 2004-70255.*
Notification of reasons of refusal dated Nov. 21, 2006 directed to counterpart Japanese application No. 2004-132540.

* cited by examiner

*Primary Examiner*—Marc S. Zimmer
(74) *Attorney, Agent, or Firm*—Morrison & Foerster LLP

(57) ABSTRACT

A transfer belt on which a developed toner image is transferred in an electrophotographic process, comprising:

a matrix resin; and a chain silicone, contained in the range from 0.5 to 10% by weight to the matrix resin, and an image-forming apparatus provided therewith.

18 Claims, 2 Drawing Sheets

TRANSFER BELT AND IMAGE-FORMING APPARATUS HAVING THE SAME

This application is based on application(s) No. 2004-132540 filed in Japan, the contents of which are hereby incorporated by reference.

BACKGROUND OF THE INVENTION

1. Field of the Invention

The present invention relates to a transfer belt which has a surface on which a toner image formed on the surface of an image-supporting member is transferred and once maintained prior to transferring the toner image onto a recording medium such as paper, and transfers the toner image onto the recording medium in an image-forming apparatus such as a copying machine and a printer, and also concerns an image-forming apparatus having such a transfer belt.

2. Description of the Prior Art

In an image-forming apparatus using an electrophotographic process, after an image-supporting member constituted of a photosensitive member has been uniformly charged, an electrostatic latent image is formed thereon by using a laser beam or the like, and the latent image is then developed by charged toner. Then, the toner image is primary-transferred onto a transfer member, and then secondary-transferred from the transfer member onto a recording medium. This system is known as an intermediate transfer system. With respect to the transfer member, a transfer belt having a belt shape is often used. The problem with the image-forming method of this type is that, after the transfer belt has been used for a long time, the surface of the transfer belt is contaminated by toner or additive agents to the toner to cause degradation in image quality.

Conventionally, in order to solve this problem, the following techniques have been proposed as means for suppressing toner adhesion onto the surface of a transfer belt (improvement for anti-filming property).

1. To use fluororesin as a belt-forming material (for example, Japanese Patent Application Laid-Open No. 2002-365866);
2. To use a thermoplastic resin on which a fluororesin surface layer is formed, as a belt-forming material (for example, Japanese Patent Application Laid-Open No. 10-207242);
3. To disperse fluorine fine particles on the surface of a thermoplastic resin belt (for example, see U.S. Pat. No. 5,666,193);
4. To coat the surface of a thermoplastic resin belt with a silicone resin (for example, Japanese Patent Application Laid-Open No. 4-029275).

The use of fluororesin as a belt-forming member, however, causes a reduction in the electric resistance in the belt and the subsequent degradation in image quality upon application of power, although it improves the anti-filming property.

The use of a belt in which fluorine fine particles are dispersed or a belt on the surface of which a fluororesin layer is formed fails to sufficiently carry out the primary transferring process to cause an image loss or the like, although it provides a sufficient toner-releasing property and improves the anti-filming property. This also causes abrasion in a cleaning blade that is placed in contact with the transfer belt, resulting in failure in exerting its functions.

Another problem is that the belt coated with silicone resin tends to cause separation of the coat layer during endurance operations.

SUMMARY OF THE INVENTION

The objective of the present invention is to provide a transfer belt which provides superior anti-filming property and transferring property on the surface for a long time, and makes it possible to suppress abrasion in the cleaning blade.

The present invention relates to a transfer belt on which a toner image is transferred from an image-supporting member in an image-forming apparatus, and the transfer belt contains a matrix resin and chain silicone, with the content of the silicone to the matrix resin being set to 0.5 to 10% by weight.

The present invention also relates to an image-forming apparatus which is provided with an image-supporting member and the above-mentioned transfer belt, and transfers a toner image formed on the surface of the image-supporting member onto the transfer belt, so that the toner image is further transferred from the transfer belt to a recording medium.

The transfer belt of the present invention is superior in the surface lubricating property. Therefore, it is possible to suppress adhesion of toner to the surface for a long time, and consequently to prevent degradation (filming) in the image. Further, it becomes possible to desirably carry out a primary transferring process from the image-supporting member to the transfer belt and a secondary transferring process from the transfer belt to a recording medium for a long time, and consequently to prevent an insufficient transferring process (image loss) of image. It is also possible to prevent abrasion in the cleaning blade.

DETAILED DESCRIPTION OF THE INVENTION

The transfer belt in accordance with the present invention is desirably used as a transfer belt for an image-forming apparatus of an intermediate transfer system provided with an image-supporting member, in particular, as a seamless belt. The transfer belt relating to the present invention is applicable to image-forming apparatuses, such as a mono-color image-forming apparatus that has only the mono-color toner in the developing device, a color-image-forming apparatus of a cycle system that carries out a developing process on the image-supporting member and a primary transferring process of a toner image onto the transfer belt for each of developing devices of respective colors of Y (yellow), M (magenta), C (cyan) and B (black), and a tandem-type color-image-forming apparatus that carries out a primary transferring process of a toner image onto a transfer belt for each of image-forming units of respective colors that are placed in series with one another. The image-supporting member may be prepared as a photosensitive member that develops an electrostatic latent image and holds the image or as a member on which an image is directly formed and held. This member is not limited to the photosensitive member, and any device may be used as long as it serves as an image-supporting member that holds an image.

Figure 1:
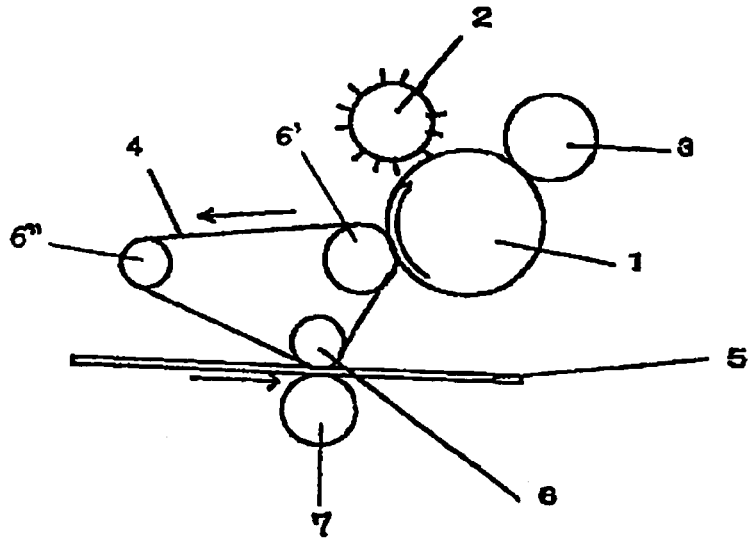
FIG. 1 is a schematic partial structural drawing that shows one example of an image-forming apparatus of an intermediate transfer system, which can use a transfer belt of the present invention.
Figure 2:
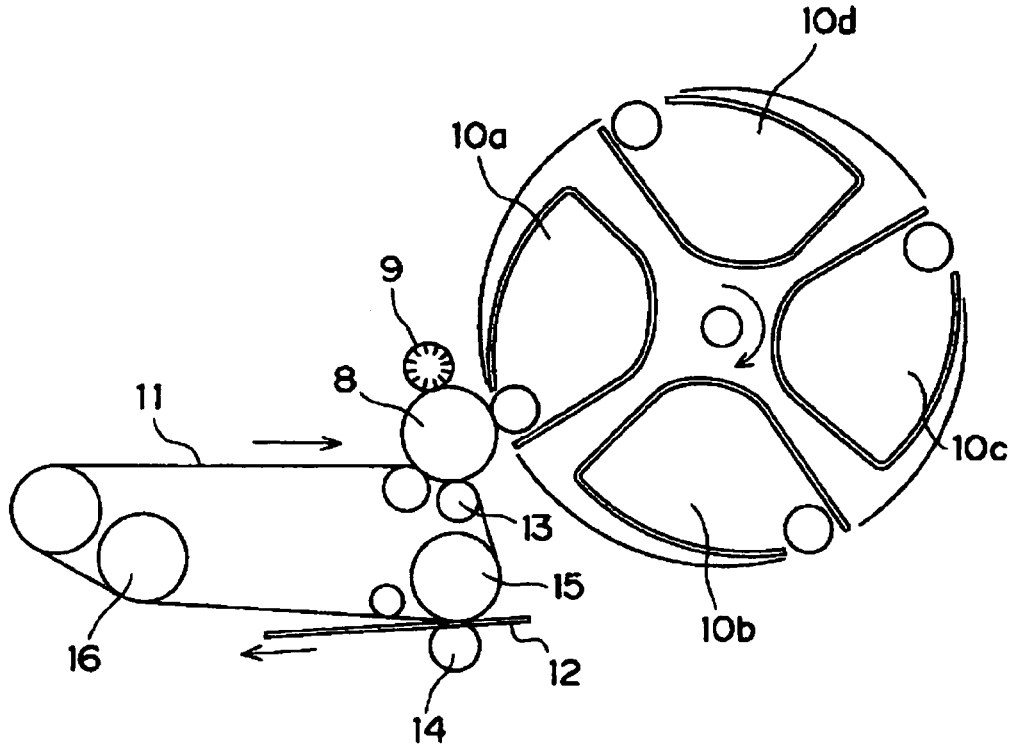
FIG. 2 is a schematic partial structural drawing that shows another example of an image-forming apparatus of an intermediate transfer system, which can use the transfer belt of the present invention.
Figure 3:
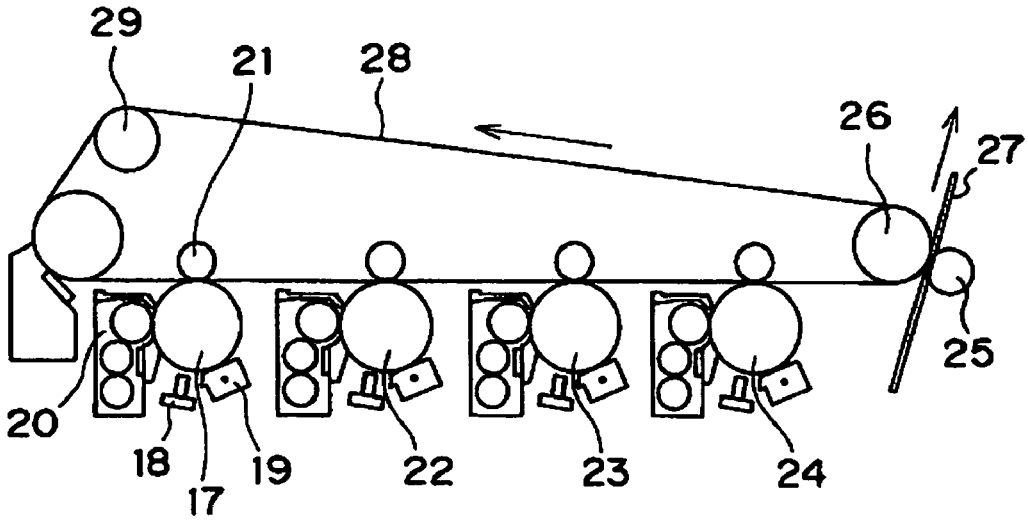
FIG. 3 is a schematic partial structural drawing that shows still another example of an image-forming apparatus of an intermediate transfer system, which can use the transfer belt of the present invention.

FIGS. 1, 2 and 3 are schematic partial structural drawings that show an image-forming apparatus of an intermediate transfer system.

In FIG. 1, reference numeral 1 represents a photosensitive member serving as an image-supporting member, and 4 represents a transfer belt. In general, a charging device, an exposure optical system that is used for forming an electrostatic latent image on the photosensitive member, a developing device that houses toner, a cleaner to be used for removing residual toner and the like are placed on the periphery of the photosensitive member; however, in FIG. 1, for convenience of explanation, only the charging device 2 for charging the photosensitive member 1 and developing device 3 that toner-develops the electrostatic latent image formed on the photosensitive member are shown.

The transfer belt 4 is laid over transfer-transport rollers 6 and 6' and a transport roller 6", and allowed to rotate in the direction of arrow in synchronism with the photosensitive member 1 that rotates in the direction of arrow.

In the image-forming apparatus having the intermediate transfer system as shown in FIG. 1, first, the surface of the photosensitive member 1 rotating in the direction of arrow is uniformly charged by the charging device 2 so that an electrostatic latent image corresponding to an image is formed by an exposure optical system, not shown. The electrostatic latent image is developed by the developing device 3 into a toner image. This toner image is electrostatically transferred on the transfer belt 4 by the transfer-transport roller 6' (primary transfer). The toner image, formed on the transfer belt 4, is transferred on recording paper 5 between the transport-transfer roller 6 and a press roller 7 (secondary transfer).

In the image-forming apparatus having the intermediate transfer system of this type, the transfer belt 4 is made in contact with the photosensitive member 1 through these rollers 6, 6' and 6", as shown in FIG. 1, while being extended through a tension force of 40 to 60 N. Here, the transfer belt 4 is allowed to rotate at a peripheral speed that is suitable for primarily transferring toner from the photosensitive member, that is, for example, 80 to 150 mm/s.

In a cycle-system color image-forming apparatus having an intermediate transfer system as shown in FIG. 2, the developing and primary transferring processes are carried out for each of the developing devices of the respective colors. More specifically, the transfer belt 11 is subjected to primary transferring processes successively through four-time transferring processes by a primary transfer roller 13, while a Y (yellow) developing device 10*a*, an M (magenta) developing device 10*b*, a C (cyan) developing device 10*c* and a B (black) developing device 10*d* are being successively rotated so that toner images are developed on the photosensitive member 8; thus, the toner images with the four colors, formed on the transfer belt 11, are transferred onto a sheet of recording paper 12 between the secondary transfer roller 14 and the press roller 15. The surface of the image-supporting member (photosensitive member) 8 is charged uniformly by the charging device 9 so that an electrostatic latent image corresponding to an image is formed by an exposure optical system, not shown, and after the developing process, residual toner is removed by a cleaner or the like, not shown.

In the image-forming apparatus of this type, the transfer belt 11 is made in contact with the photosensitive member 8 through several rollers 13, 15 and 16, etc., with being extended through a tension of 40 to 60 N. The transfer belt 11 is allowed to rotate at a peripheral speed that is suitable for the primarily transferring process, that is, for example, 80 to 150 mm/s.

In a tandem-system image-forming apparatus having an intermediate transfer system as shown in FIG. 3, the developing and primary transferring processes are carried out for each of the colors with respect to each of image-forming units placed in series with one another. More specifically, a transfer belt 28 is subjected to primary transferring processes of toner images on the respective photosensitive members through a Y (yellow)-use photosensitive member 17, an M (magenta)-use photosensitive member 22, a C (cyan)-use photosensitive member 23 and a B (black)-use photosensitive member 24 by respective primary transfer rollers 21 through a one-time transporting operation, so that toner images with four colors, formed on the transfer belt 28, are transferred onto a sheet of recording paper 27 between a secondary transfer roller 25 and a press roller 26. In each of the developing devices (for example, 20), the surface of each of the photosensitive members (for example, 17) is charged uniformly by a charging device (for example, 19) so that an electrostatic latent image corresponding to an image is formed thereon by an exposure device (for example, 18), and after the developing process, residual toner is removed by a cleaner or the like, not shown.

In the image-forming apparatus of this type, the transfer belt 28 is made in contact with the respective photosensitive members in the respective units in which a Y (yellow)-use photosensitive member 17, an M (magenta)-use photosensitive member 22, a C (cyan)-use photosensitive member 23 and a B (black)-use photosensitive member 24 are series-aligned face to face with the respective primary transfer rollers 21, with being extended through a tension of 40 to 60 N through several rollers 26, 29, etc. The transfer belt 28 is allowed to rotate at a peripheral speed that is suitable for primarily transferring toner images with four colors through a one-time transferring process, that is, for example, 80 to 150 mm/s.

The transfer belt of the present invention to be used for the above-mentioned image-forming apparatus contains matrix resin and silicone.

With respect to the matrix resin, not particularly limited, a thermoplastic resin is desirably used from the viewpoint of easiness in the molding process. With respect to such a thermoplastic resin, examples thereof include: polyamide, polyimide, polyacetal, polycarbonate, polyalkylene terephthalate, polyether sulfone, polyphenylene sulfide and a mixture thereof. These resins, which are extrusion-moldable, are, in particular, preferably used.

Chain silicone to be used in the present invention is not particularly limited, as long as it is constituted by a polysiloxane skeleton made of repeated siloxane bonds with an organic group added thereto; and from the viewpoint of easiness in manufacturing the transfer belt (moldability), chain organopolysiloxane (I) represented by the following formula (I) and a mixture thereof are preferably used:

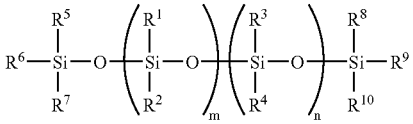

In the formula (I), each of $R^1$ to $R^{10}$ independently represents a hydrogen atom, an alkyl group or an aryl group. The alkyl group, having 1 to 3 carbon atoms, in particular, 1 to 2 carbon atoms, is preferably used, and examples thereof include: a methyl group, an ethyl group, and a propyl group. With respect to the aryl group, that having 6 to 10 carbon atoms, in particular, 6 carbon atoms, is preferably used, and examples thereof include a phenyl group and a naphthyl group.

Here, m and n are not limited as long as the objective of the present invention is achieved, and for example, the sum of m and n is set to such a value that organopolysiloxane (I) is allowed to have an average molecular weight that will be described later.

In preferable organopolysiloxane (I), each of $R^1$ to $R^3$ and $R^5$ to $R^{10}$ is independently an alkyl group, in particular, a methyl group, and $R^4$ is a hydrogen atom, an alkyl group or an aryl group, in particular, a hydrogen atom, a methyl group or a phenyl group. In this case, a ratio n/m is preferably set in the range from 0 to 100, in particular, from 0 to 50.

Here, m and n respectively indicate the number or the ratio of the respective monomer units, and the composition is not limited to a block copolymer in which the monomer units indicated by m and n attached thereto are respectively polymerized continuously. In other words, those having various polymerization forms, such as a block copolymer and a random copolymer, may be used as organopolysiloxane (I).

Desirable specific examples of organopolysiloxane (I) are shown as follows:

(a)

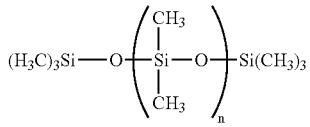

(b)

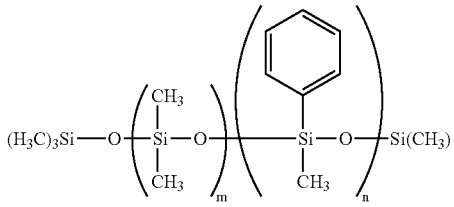

(c)

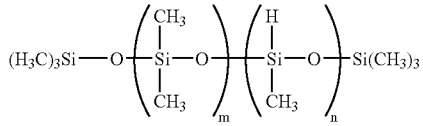

Organopolysiloxane (I), which has an oil form or a gum form at room temperature, has an average molecular weight of not less than 100,000, preferably in the range from 100,000 to 5,000,000, more preferably in the range from 100,000 to 2,000,000. When the average molecular weight is too small, the toner releasing property and lubricating property are lowered, with the result that the cleaning blade is more susceptible to abrasion to cause a reduction in anti-abrasion property.

The average molecular weight corresponds to a weight-average molecular weight (polystyrene conversion) obtained from a peak value in a molecular weight distribution curve that is formed based upon measurements through gel-permeation chromatography (GPC) using a tetrahydrofran solvent.

Organopolysiloxane (I) can be synthesized through the following method:

Organopolysiloxane (I) can be produced through a known method. For example, it is manufactured by heating and mixing cyclic siloxane by using an extruder in the presence of a basic catalyst so as to be ring-opened and polymerized.

Organopolysiloxane (I) is available as the following commercial products:

The organopolysiloxane, represented by the above-mentioned formula (a), is, for example, available as a commercial product SH-200 (made by Dow Corning Toray Silicone Co., Ltd.).

The organopolysiloxane, represented by the above-mentioned formula (b), is, for example, available as commercial products SH-510, SH-550, SH-710, SH-704 and SH-705 (made by Dow Corning Toray Silicone Co., Ltd.).

The organopolysiloxane, represented by the above-mentioned formula (c), is, for example, available as a commercial product SH-1107 (made by Dow Corning Toray Silicone Co., Ltd.).

The transfer belt of the present invention contains the above-mentioned silicone in the matrix resin so that the surface lubricating properties thereof are remarkably improved. Therefore, the improved effects for anti-filming property and for transferring property are maintained for a long time. Moreover, it becomes possible to suppress abrasion in the cleaning blade. The mechanism by which such effects are provided has not been clarified yet; however, it is presumably explained as follows: The above-mentioned silicone, which has polysiloxane chain that is comparatively rich in the flexibility, becomes flexible, and its intermolecular cohesion is comparatively small; therefore, even when the polysiloxane chain is comparatively long, it can be dispersed uniformly in the matrix resin. For this reason, the lubricating properties, derived from the organic group in the polysiloxane chain, are applied to the surface of the transfer belt uniformly and continuously. As a result, the anti-filming property, transferring property and abrasion-resistant property of the belt are remarkably improved, and these superior properties are maintained for a long time.

Although not particularly limited as long as the effects of the present invention are obtained, the content of silicone is normally set in the range from 0.5 to 10% by weight, preferably from 1 to 5% by weight, with respect to the matrix resin. When the content is too small, the improved effect for lubricating properties is not exerted efficiently to cause filming and abrasion in the blade. When the content is excessive, there is degradation in the transferring property, in particular, in the primary transferring performance, although the anti-filming property and the abrasion-resistant property are improved.

Normally, a substance capable of imparting conductivity is contained in the transfer belt of the present invention. Examples of such a conductive substance include: carbon-based fillers, such as carbon black, carbon fiber and graphite, and metal-based fillers etc. Carbon-based fillers are preferably used. Among the carbon-based fillers, carbon black, in particular, acetylene black, is preferably used because of its small impurity content and its conductivity.

The transfer belt of the present invention may contain other additives as long as the above-mentioned objective of the present invention can be achieved. With respect to the other additives, a lubricant, an anti-oxidant, an ultraviolet absorber and the like are listed.

With respect to the lubricant that is used for improving the moldability to a belt, examples thereof include: aliphatic hydrocarbon materials, such as paraffin wax and polyolefin wax; higher fatty acids having 9 or more carbon atoms, such as lauric acid, myristic acid, palmitic acid, stearic acid, behenic acid, montan acid, melissic acid, oleic acid and erucic acid; higher fatty acid metal salts, such as sodium salt, lithium salt, calcium salt, magnesium salt, zinc salt and aluminum salt of these higher fatty acids; higher fatty alcohol such as stearyl alcohol; higher fatty acid amides, such as stearic acid amide, erucic acid amide and ethylene bisstearic acid amide; and higher fatty acid esters, such as stearyl stearate and montan wax. Preferably, higher fatty acid metal salts, in particular, such as calcium montanate, sodium montanate, aluminum stearate and calcium stearate, are used.

The transfer belt of the present invention may be manufactured by using any method as long as it allows molding processes to a belt form. In particular, in the case when a seamless belt is desirably used as the transfer belt, for example, a ring-shaped die is attached to a single-screw extruder, and a mixture composed of the above-mentioned materials is put therein, and the resulting molten resin composition is extruded from a resin outlet having a seamless belt shape at the tip of the ring-shaped die, and then externally put around a cooling cylinder having a cooling mechanism so that the resin is solidified and easily formed into a seamless cylinder shape.

In this case, in order to prevent crystallization, immediately after discharged from the mold, the belt is preferably subjected to a cooling process by using water, air, a cooled metal block or the like. More specifically, a cooling cylinder, provided through the intermediary of a heat-insulating material between the metal mold and the cooling cylinder, is used so as to abruptly absorb heat from the belt. Water, adjusted to a temperature of not more than 30° C., is always circulated through the inside of the cooling cylinder. Alternatively, the belt discharged from the metal mold may be drawn at a high speed to be made thinner so as to increase the cooling rate. In this case, the drawing speed is set to not less than 1 m/min, more preferably to 2 to 7 m/min.

The transfer belt of the present invention finally prepared has the following physical properties:

Thickness: 100–180 μm, preferably 120–160 μm;

Surface resistance value: $1\times10^{8}$–$1\times10^{12}$ Ω/□, preferably $1\times10^{10}$–$9\times10^{11}$ Ω/□;

Volume resistance value: $1\times10^{6}$–$1\times10^{11}$ Ω·cm, preferably $1\times10^{9}$–$9\times10^{10}$ Ω·cm;

Ratio r of surface resistance value/volume resistance value: $r\geqq0.1$, preferably $r\geqq0.5$, particularly $r\geqq1$;

Surface roughness: 0.2 μm–0.5 μm.

When the surface resistance value or the volume resistance value is set in the above-mentioned range, it becomes possible to effectively solve the problem of toner scattering upon transferring in the case when the resistance value is too small and the problem of degradation in the transferring property due to degradation in the self-static-eliminating property of the intermediate transfer belt in the case when the resistance value is too big.

When r is set in the above-mentioned range, the conductivity of the transfer belt becomes isotropic so that the transferring property is effectively improved. By setting the surface roughness in the above-mentioned range, it becomes possible to improve the primary and secondary transferring functions and the cleaning properties.

EXAMPLES

In the present examples, the following materials are used.

Matrix Resin

PBT: Polybutylene terephthalate (made by Mitsubishi Engineering-Plastics Corporation)

PC: Polycarbonate (made by Mitsubishi Engineering-Plastics Corporation)

PPS: Polyphenylene sulfide (made by Toray Industries. Inc.)

Carbon Black

Acetylene black (made by Denka Co., Ltd.)

Silicone

Silicone A: Organopolysiloxane represented by the above-mentioned formula (a) (average molecular weight: 1,000,000)(SH-200; made by Dow Corning Toray Silicone Co., Ltd.)

Silicone B: Organopolysiloxane represented by the above-mentioned formula (b) (average molecular weight:300,000)(SH-510; made by Dow Corning Toray Silicone Co., Ltd.)

Silicone C: Organopolysiloxane represented by the above-mentioned formula (c) (average molecular weight 100,000)(SH-1107; made by Dow Corning Toray Silicone Co., Ltd.)

<Belt Manufacturing Processes>

Examples 1 to 7 and Comparative Examples 1 to 3

A mixture composed of a matrix resin, carbon black and silicone listed in Table 1 or Table 2 was melt and kneaded by using a twin-screw extruder to obtain an extruded resin composition. The resin composition was extrusion-molded by using a molding machine to which a ring-shaped metal die was attached; thus, a transfer belt having a seamless form was obtained. In comparative example 3, polytetrafluoroethylene (PTFE) fine particles (made by Kitamura LTD.) were used in place of silicone.

<Evaluation>

(Surface Resistance, Volume Resistance)

The surface resistance value was measured by using an ohmmeter (Hiresta made by Mitsubishi Petrochemical Co., Ltd.) at a measuring voltage of 500 V for a measuring time of 10 seconds. With respect to the measurements for the surface resistance value and volume resistance value, measurements were carried out at 20 points with intervals of 20 mm in the extrusion direction as well as in the direction perpendicular to the extrusion direction, and evaluation was made based upon the average value of these values.

(Surface Roughness)

By using a surface roughness meter (made by Tokyo Seimitsu Co., Ltd.), an average roughness on ten points (Rz: ten point height of roughness profile) was measured based upon JIS B0601.

(Anti-filming Property)

Endurance printing tests of 10,000 copies of a full-color image (C/W ratio 20%) were carried out by using a Color Page Pro made by Minolta Co., Ltd. in which each of the transfer belts obtained in the respective examples and comparative examples was installed, and the adhering state of toner to the surface of the belt was visually evaluated.

○: No toner adhesion was found.

Δ: Although slight adhesion of toner was found, there was no degradation in the image.

X: Toner adhesion was found with degradation in the image.

(Image Loss)

Endurance printing tests were carried out by using the same method as the method for the anti-filming property, and after each of toner images of yellow, magenta, cyan and black toner images had been transferred from the transfer belt onto a sheet of recording paper, image loss of characters was evaluated.

○: No image loss was found.

Δ: Image loss was slightly observed (practically applicable level).

X: Image loss was observed remarkably.

(Blade Abrasion)

After endurance printing tests had been carried out by using the same method as the method for the anti-filming property, the amount of abrasion on the tip of the cleaning blade was measured.

○: Amount of abrasion from the blade tip is not more than 10 μm.

Δ: Amount of abrasion from the blade tip is more than 10 μm and not more than 20 μm.

X: Amount of abrasion is more than 20 μm.

TABLE 1

| | Example 1 | Example 2 | Example 3 | Example 4 | Example 5 | Example 6 | Example 7 |
|---|---|---|---|---|---|---|---|
| Matrix resin (parts by weight) | PBT/PC (50/50) | PBT/PC (50/50) | PBT/PC (50/50) | PBT/PC (50/50) | PBT/PC (50/50) | PBT/PC (50/50) | PPS (100) |
| Carbon black (parts by weight) | acetylene black (11) | acetylene black (11) | acetylene black (11) | acetylene black (11) | acetylene black (11) | acetylene black (11) | acetylene black (11) |
| Silicone (parts by weight) | A (2) | A (0.5) | A (10) | B (1) | B (5) | C (2) | B (2) |
| Surface resistance Ω/□ | $3.00 \times 10^{10}$ | $5.00 \times 10^{10}$ | $3.00 \times 10^{9}$ | $3.00 \times 10^{10}$ | $3.00 \times 10^{10}$ | $3.00 \times 10^{10}$ | $5.00 \times 10^{10}$ |
| Volume resistance Ω · cm | $2.00 \times 10^{10}$ | $7.00 \times 10^{10}$ | $1.00 \times 10^{9}$ | $5.00 \times 10^{10}$ | $3.00 \times 10^{10}$ | $3.00 \times 10^{10}$ | $9.00 \times 10^{9}$ |
| Thickness (μm) | 150 | 130 | 155 | 150 | 150 | 140 | 140 |
| Surface roughness(μm) | 0.3 | 0.3 | 0.3 | 0.4 | 0.4 | 0.3 | 0.3 |
| Anti-filming property | ○ | Δ | ○ | ○ | ○ | Δ | ○ |
| Image loss | ○ | ○ | Δ | ○ | ○ | ○ | ○ |
| Blade abrasion | ○ | Δ | ○ | ○ | ○ | Δ | ○ |

TABLE 2

| | Comparative example 1 | Comparative example 2 | Comparative example 3 |
|---|---|---|---|
| Matrix resin (parts by weight) | PBT/PC (50/50) | PBT/PC (50/50) | PPS (100) |
| Carbon black (parts by weight) | acetylene black (11) | acetylene black (11) | acetylene black (11) |
| Silicone (parts by weight) | B (0.4) | B (11) | PTFE (4) |
| Surface resistance Ω/□ | $9.00 \times 10^{9}$ | $5.00 \times 10^{10}$ | $5.00 \times 10^{10}$ |
| Volume resistance Ω · cm | $9.00 \times 10^{9}$ | $3.00 \times 10^{9}$ | $9.00 \times 10^{9}$ |
| Thickness (μm) | 150 | 150 | 150 |
| Surface roughness (μm) | 0.3 | 0.3 | 0.3 |

TABLE 2-continued

| | Comparative example 1 | Comparative example 2 | Comparative example 3 |
|---|---|---|---|
| Anti-filming property | X | ○ | ○ |
| Image loss | ○ | X | X |
| Blade abrasion | X | ○ | ○ |

What is claimed is:

1. A transfer belt on which a developed toner image is transferred in an electrophotographic process, comprising:

a matrix resin; and a chain silicone, contained in the range from 0.5 to 10% by weight to the matrix resin, wherein the chain silicone has an weight-average molecular weight of not less than 100,000.

2. The transfer belt of claim 1, wherein the matrix resin is a thermoplastic resin.

3. The transfer belt of claim 1, wherein the chain silicone is a chain organopolysiloxane represented by the following formula and a mixture thereof:

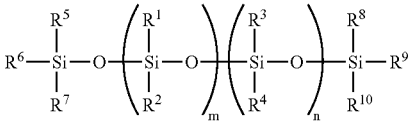

in which $R^1$ to $R^{10}$ independently represent a hydrogen atom, an alkyl group having 1 to 3 carbon atoms or an aryl group having 6 to 10 carbon atoms; m and n show a ratio of respective monomer unit having n/m of 0 to 100.

4. The transfer belt of claim 3, wherein $R^1$ to $R^3$ and $R^5$ to $R_{10}$ are methyl groups, and $R^4$ is a hydrogen atom, a methyl group or a phenyl group.

5. The transfer belt of claim 1, wherein a weight-average molecular weight of the chain silicone is in the range from 100,000 to 5,000,000.

6. A transfer belt on which a developed toner image is transferred in an electrophotographic process, comprising:

a matrix resin;

a chain silicone, contained in the range from 0.5 to 10% by weight to the matrix resin;

a surface resistance value of $1\times10^{8}$–$1\times10^{12}$ Ω/□;

a volume resistance value of $1\times10^{6}$–$1\times10^{11}$ Ω·cm; and a ratio r of surface resistance value/volume resistance value of r≧0.1.

7. The transfer belt of claim 1, having a surface roughness of 0.2 μm–0.5 μm.

8. The transfer belt of claim 1, in which the chain silicone exists at the surface and inside of the transfer belt.

9. A transfer belt on which a developed toner image is transferred in an electrophotographic process, comprising:

a matrix resin; and a chain silicone, contained in the range from 0.5 to 10% by weight to the matrix resin, wherein the transfer belt is prepared by extruding a mixture containing the matrix resin and the chain silicone.

10. An image-forming apparatus, comprising:

an image-supporting member on the surface of which electrostatic latent images are to be formed;

a developing device for developing the electrostatic latent images with a toner; and a transfer belt on which the developed toner images are to be transferred, the transfer belt comprising:

a matrix resin; and a chain silicone, contained in the range from 0.5 to 10% by weight to the matrix resin, wherein the chain silicone has an weight-average molecular weight of not less than 100,000.

11. The image-forming apparatus of claim 10, wherein the matrix resin is a thermoplastic resin.

12. The image-forming apparatus of claim 10, wherein the chain silicone is a chain organopolysiloxane represented by the following formula and a mixture thereof:

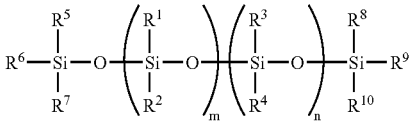

in which $R^1$ to $R^{10}$ independently represent a hydrogen atom, an alkyl group having 1 to 3 carbon atoms or an aryl group having 6 to 10 carbon atoms; m and n show a ratio of respective monomer unit having n/m of 0 to 100.

13. The image-forming apparatus of claim 12, wherein $R^1$ to $R^3$ and $R^5$ to $R^{10}$ are methyl groups, and $R^4$ is a hydrogen atom, a methyl group or a phenyl group.

14. The image-forming apparatus of claim 10, wherein a weight-average molecular weight of the chain silicone is in the range from 100,000 to 5,000,000.

15. An image-forming apparatus, comprising:

an image-supporting member on the surface of which electrostatic latent images are to be formed;

a developing device for developing the electrostatic latent images with a toner; and a transfer belt on which the developed toner images are to be transferred, the transfer belt comprising:

a matrix resin; and a chain silicone, contained in the range from 0.5 to 10% by weight to the matrix resin, and wherein the transfer belt has:

a surface resistance value of $1\times10^{8}$–$1\times10^{12}$ Ω/□;

a volume resistance value of $1\times10^{6}$–$1\times10^{11}$ Ω·cm; and a ratio r of surface resistance value/volume resistance value of r≧0.1.

16. The image-forming apparatus of claim 10, wherein the transfer belt has a surface roughness of 0.2 μm–0.5 μm.

17. The image-forming apparatus of claim 10, wherein the chain silicone exists at the surface and inside of the transfer belt.

18. An image-forming apparatus, comprising:

an image-supporting member on the surface of which electrostatic latent images are to be formed;

a developing device for developing the electrostatic latent images with a toner; and a transfer belt on which the developed toner images are to be transferred, the transfer belt comprising:

a matrix resin; and a chain silicone, contained in the range from 0.5 to 10% by weight to the matrix resin, and wherein the transfer belt is prepared by extruding a mixture containing the matrix resin and the chain silicone.

* * * * *

UNITED STATES PATENT AND TRADEMARK OFFICE

CERTIFICATE OF CORRECTION

PATENT NO. : 7,215,913 B2
APPLICATION NO. : 10/918422
DATED : May 8, 2007
INVENTOR(S) : Takahito Miyamoto It is certified that error appears in the above-identified patent and that said Letters Patent is hereby corrected as shown below:

In Claim 1, column 10, line 21, after phrase "wherein the chain silicone has an" delete --weight- --

In Claim 4, column 10, line 66 delete "$R_{10}$" and replace with --$R^{10}$--

In Claim 6, column 11, line 12 delete "r≧" and replace with --r≥--

In Claim 10, column 11, line 36 after phrase "wherein the chain silicone has an" delete --weight- --

In Claim 15, column 12, line 27 delete "r≧" and replace with --r≥--

Signed and Sealed this

Twentieth Day of November, 2007

JON W. DUDAS
*Director of the United States Patent and Trademark Office*